US009739553B1

(12) United States Patent
Gibbons, III et al.

(10) Patent No.: US 9,739,553 B1
(45) Date of Patent: Aug. 22, 2017

(54) MUZZLE LOADING CONVERSION SYSTEM FOR A RIFLE

(71) Applicants: Gould Gibbons, III, Westminster, MD (US); Ronald G. Sebeck, Jr., Westminster, MD (US); Andrew Gibbons, Westminster, MD (US); Matthew Gibbons, Westminster, MD (US)

(72) Inventors: Gould Gibbons, III, Westminster, MD (US); Ronald G. Sebeck, Jr., Westminster, MD (US); Andrew Gibbons, Westminster, MD (US); Matthew Gibbons, Westminster, MD (US)

( * ) Notice: Subject to any disclaimer, the term of this patent is extended or adjusted under 35 U.S.C. 154(b) by 0 days.

(21) Appl. No.: 15/189,227

(22) Filed: Jun. 22, 2016

(51) Int. Cl.

| | |
|---|---|
| ***F41C 27/00*** | (2006.01) |
| ***F41A 11/02*** | (2006.01) |
| ***F41A 3/66*** | (2006.01) |
| ***F41C 9/08*** | (2006.01) |
| ***F41C 7/00*** | (2006.01) |

(52) U.S. Cl.
CPC ..... *F41A 11/02* (2013.01); *F41A 3/66* (2013.01); *F41C 7/00* (2013.01); *F41C 9/08* (2013.01)

(58) Field of Classification Search
CPC .... F41A 11/02; F41A 3/66; F41C 7/00; F41C 9/08
See application file for complete search history.

(56) References Cited

U.S. PATENT DOCUMENTS

| | | | | | |
|---|---|---|---|---|---|
| 4,227,330 | A * | 10/1980 | Chapin | F41C 9/08 | 42/51 |
| 5,010,677 | A * | 4/1991 | Verney Carron | F41C 9/08 | 102/446 |
| 5,307,583 | A * | 5/1994 | Mahn | F41C 9/08 | 42/51 |
| 5,408,776 | A * | 4/1995 | Mahn | F41C 9/08 | 42/51 |
| 5,511,334 | A * | 4/1996 | Ball | F41C 9/08 | 42/51 |
| 5,642,583 | A * | 7/1997 | Ball | F41C 9/08 | 42/51 |
| 5,915,934 | A * | 6/1999 | Knight | F41A 3/18 | 42/51 |
| 6,176,030 | B1 * | 1/2001 | Ball | F41C 9/08 | 42/51 |
| 6,189,253 | B1 * | 2/2001 | Knight | F41A 3/18 | 42/16 |
| 8,079,167 | B1 * | 12/2011 | Overstreet | F41C 9/08 | 42/51 |

(Continued)

*Primary Examiner* — Samir Abdosh
(74) *Attorney, Agent, or Firm* — Rosenberg, Klein & Lee

(57) ABSTRACT

A muzzle loading conversion system for a rifle having an upper and lower receiver. A barrel is slidingly secured to the upper receiver. A stationary bolt member is positioned within the upper receiver with a firing pin slidably received within a bolt opening. A breech plug mechanism is threadedly secured to the barrel within a barrel end section and the breech plug mechanism is adapted to receive a primer within a breech plug mechanism chamber which is in fluid communication with the bolt through opening. The breech plug mechanism is engaged with the bolt member within a breech plug member receiving chamber.

17 Claims, 8 Drawing Sheets

(56) References Cited

U.S. PATENT DOCUMENTS

| | | | | |
|---|---|---|---|---|
| 8,826,797 | B2 * | 9/2014 | Overstreet | F41A 3/12 89/128 |
| 2010/0024272 | A1 * | 2/2010 | Laney | F41A 3/18 42/51 |
| 2011/0005116 | A1 | 1/2011 | Laney | |
| 2012/0005931 | A1 * | 1/2012 | Kelly | F41A 21/10 42/14 |

* cited by examiner

MUZZLE LOADING CONVERSION SYSTEM FOR A RIFLE

FIELD OF THE INVENTION

This invention is related to the field of weaponry used for game hunting. In particular, this invention is related to the field of using semi-automatic style rifles in game hunting which complies with statutory and regulations associated with weaponry used in game hunting.

In particular, this invention relates to the field of firearms and more in particular, to muzzle loading firearms. Still further, this invention relates to conversion kits for converting semi-automatic rifles to muzzle loading rifles which comply with statutory and regulations imposed by the Government.

Still further, this invention pertains to muzzle loading rifles which have been converted from semi-automatic rifles to permit muzzle loading.

Still further, this invention pertains to semi-automatic rifles in the nature of AR-15 rifle upper receiver assemblies which are convertible to a muzzle loading rifle.

More in particular, this invention relates to rifle systems where the conversion kit provides particular and unique bolt members with a firing pin slidably received within the bolt and a breech plug mechanism secured to the rifle barrel with the breech plug mechanism adapted to receive a primer within a breech plug mechanism chamber.

Additionally, this invention relates to a conversion kit for semi-automatic rifles which provides a unique breech plug member having a breech plug nozzle through opening which is in fluid communication with a breech plug through opening and the internal chamber of the muzzle loading barrel.

This invention further relates to a muzzle loading conversion system for a rifle which has a locking mechanism insertable within a stationary bolt mechanism of an upper receiver of the rifle.

Further, and more in particular, this invention relates to a bolt locking mechanism adapted to be received in a recess of the bolt member to maintain the bolt in a stationary position.

Further, this invention is directed to a bolt alignment member which is fixedly mounted to the bolt of the rifle for maintaining the bolt in a substantially fixed rotational position.

Still further, and in general concept, this invention relates to a conversion system for a semi-automatic rifle which transforms the semi-automatic center fire rifle into a muzzle loading firearm by means of replacing the upper receiver assembly.

Still further, this invention is particularly directed for use in conversion of a standard AR-15 rifle from a semi-automatic to a muzzle loading firearm which may be used in game hunting.

BACKGROUND OF THE INVENTION

Muzzle loading rifles were the initial type of firearms developed. Such muzzle loading rifles have previously been categorized by the ignition system used for igniting a powder propellant. Lock rifles were first used followed by flint lock rifles and then percussion rifles and in some recent developments, in-line rifles.

Previous wheel lock rifles were initially developed and have a rotating lock carrying a fuse which passes through a hole in the barrel and ignites the powder. In opposition, flint lock rifles use flint stone carried at the end of a rotating hammer to ignite a powder charged in a striker pan. This sends a flame through the flash hole to the primary black powder charge in the barrel. In the case of percussion rifles, a hammer generally ignites a percussion cap placed on a nipple with the percussion cap having an incendiary compound producing a flame which passes through a flash hole to the primary powder charge in the barrel.

Modern in-line muzzle loaders may have a removable breech plug which is machined for receiving a standard primer and has a flash hole extending into the primary powder charge in the barrel. The most commonly used ignition systems on modern muzzle loaders are percussion and in-line ignition systems.

Standard AR-15 rifles are generally not adaptable for game hunting. Numerous municipalities have restrictions against the use of semi-automatic rifles for use in game hunting.

In many States and Counties in the United States, it is not permitted to use high powered rifles in game hunting and thus, a standard AR-15 rifle cannot be used.

In many instances, the ergonomics of standard AR-15 rifles are pleasing to hunters, however, such cannot be used in various States, such as Pennsylvania, and thus, the hunters are restricted from use of the AR-15 rifles.

Thus, in order to accommodate both the statutory and other regulations of many jurisdictions and the desire of sportsmen to have the feel of a standard semi-automatic rifle to hunt, there is needed a conversion kit which takes the basic components of a semi-automatic rifle and converts it to a muzzle loading system.

In order to comply with statutory considerations and the desires of game hunters, the conversion system as provided by this system permits statutory compliance and accommodates the user's desires for an ergonomic type of gun system.

SUMMARY OF THE INVENTION

A muzzle loading conversion system for a rifle which has an upper receiver assembly mounted to a lower receiver assembly of the rifle. A barrel has an internal thread which is slidingly secured on the upper receiver. A bolt member is positioned within the upper receiver and has a bolt first section and a bolt second section with the bolt first section having a bolt through opening passing therethrough. A firing pin is slidably received within the bolt through opening and a breech plug mechanism is threadedly secured to the barrel and is adapted to receive a primer within a breech plug mechanism chamber.

The muzzle loading conversion system breech plug mechanism includes a breech plug with a longitudinally extending breech plug through opening and a breech plug nozzle member having a breech plug nozzle through opening in fluid communication with the breech plug through opening and the barrel. The muzzle loading conversion system includes a stationary bolt holding mechanism where there is an assist mount which is fixedly secured to the upper receiver and the assist mount has a threaded through opening. A bolt locking mechanism threadedly engages with the assist mount through opening with the bolt locking mechanism engaging with a recess formed in a bolt section for maintaining the bolt in a stationary position.

A bolt alignment member is secured to the bolt for slidable insert into an upper receiver slot for negating rotation of the bolt with respect to the longitudinal direction.

An object of the subject system is to provide a conversion system that is comprised of a complete upper receiver assembly that has been converted to function as a modern, in-line, single shot muzzle-loading rifle that is substantially more weather resistant than prior muzzle loading rifles known in the art.

A still further object of the subject conversion system is to provide a muzzle loading rifle system which substantially maintains the ergonomic effects to the user of a semi-automatic rifle system.

A still further object of the subject conversion system is to provide a substantially ergonomically contoured rifle which may be used in a variety of jurisdictions for game hunting where semi-automatic rifle systems are prohibited.

A still further object of the subject conversion system is to provide a complete upper receiver assembly which allows the game hunter to easily convert the semi-automatic rifle system to a muzzle loading rifle.

A further object of the conversion system is to provide to the user a muzzle loading firearm which has the ergonomic properties of an AR-15 rifle.

A still further object of the rifle conversion system is to provide the user with a muzzle loading rifle which has the feel of a semi-automatic rifle.

PRIOR ART

Muzzle loading firearms are well-known in the art.

Prior art systems such as that shown and described in Patent Application Publication #2010/0024272 provide for muzzle loading rifles with removable breech plugs. However, such breech plugs, although being secured to a firearm barrel, do not provide for adaptability to an automatic and/or semi-automatic rifle system. Such breech plug mechanisms provide for through openings, however, such do not provide for a breech plug nozzle member through opening which is in fluid communication with the breech plug through opening of the barrel. Such systems do not provide for a breech plug nozzle threadedly insertable within the breech plug member 50 (FIG. 3) to provide a pathway for ignition gases to ignite the powder, as is necessary to the subject system.

Other prior art systems, such as U.S. Pat. No. 8,079,167 show muzzle loading rifles with center fire cartridge ignition. However, such prior art systems do not provide for the breech plug member to be threadedly engaged with inner threads formed within an inner surface of the barrel, nor does it provide for the breech plug nozzle being insertable in a threaded manner within the breech plug member.

Other prior art references, such as that provided in Patent Application Publication #2011/0005116 are directed to muzzle loading rifles with breech plugs having gas seals. However, once again, although the breech plug is threaded within the rifle barrel, such does not provide for any breech plug nozzle associated with the breech plug, as is necessary to the subject system.

Other prior art references, such as U.S. Pat. No. 8,826,797 are directed to conversion type kits for modifying an upper receiver for an AR-15 type firearm. However, such systems are directed to attachments for adapting the upper receiver to receive right/left handed shooters and does not provide for the conversion of such AR-15 rifles to a muzzle loading firearm system.

Other prior art systems, such as that shown in Patent Application Publication #2012/0005931 provide for various conversions of a semi-automatic rifle wherein a retrofit chamber adaptor is associated with a substitute action assembly incorporated into the firearm for preventing the substitution of an original designated cartridge for a substitute cartridge. However, although directed to a conversion type system, these do not provide for the conversion of a semi-automatic firearm into a muzzle loading firearm.

DESCRIPTION OF THE PREFERRED EMBODIMENTS

Figure 1:
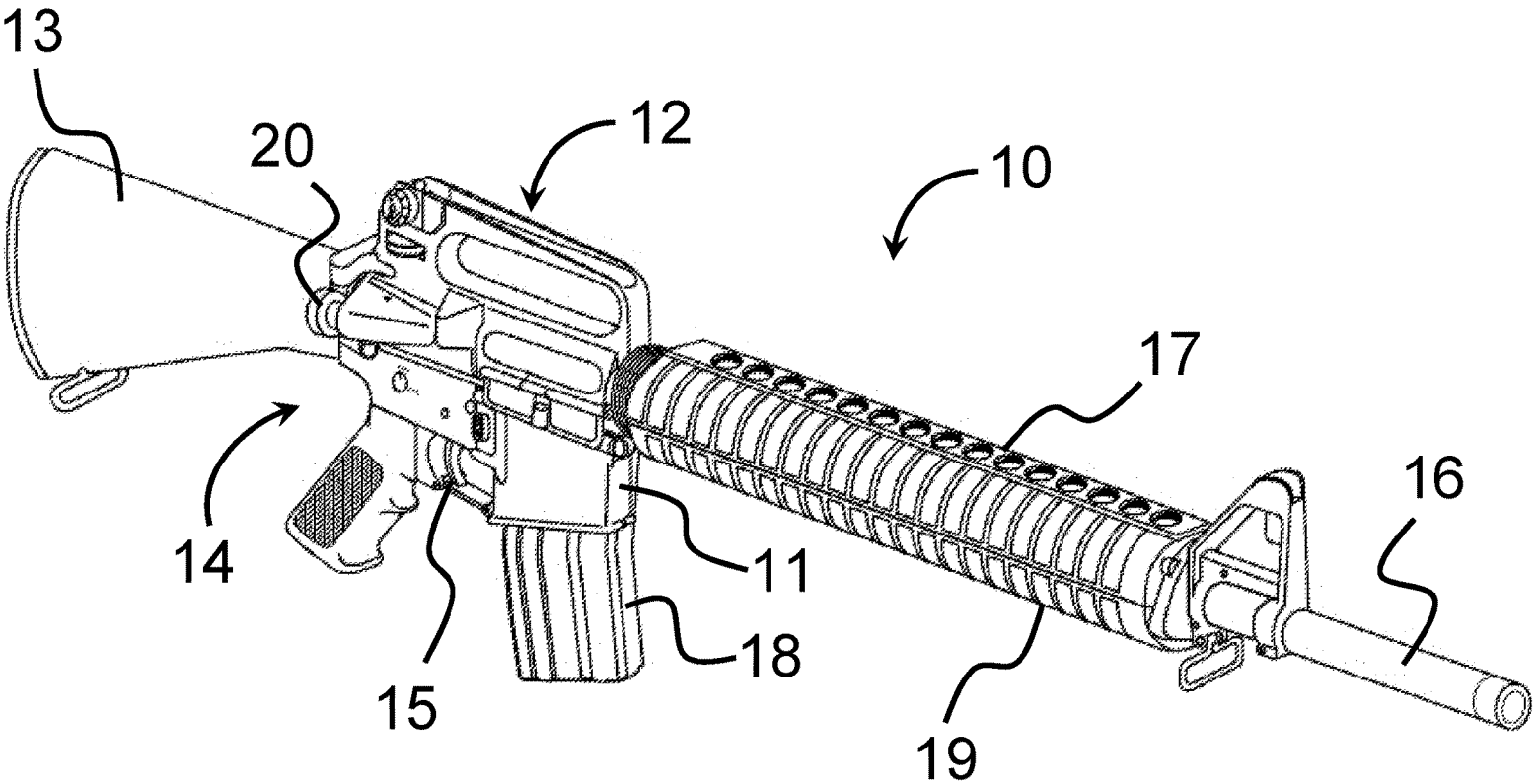
Fig. 1 Prior Art
FIG. 1 is a perspective drawing of a standard conventional semi-automatic AR15-type rifle.

Referring now to FIG. 1, there is shown a standard AR-15 rifle 10 adapted for semi-automatic firing. The subject system in particular is directed to a muzzle loading conversion system for converting the AR-15 standard rifle 10 to a single shot muzzle loading firing system. The standard AR-15 rifle 10 includes what is commonly known as an upper receiver assembly 12 and a lower receiver assembly 14, which are matingly engaged to each other, as shown in FIG. 1. The lower receiver assembly 14 of the standard AR-15 rifle 10 has a lower housing 11 into which is inserted the insertable magazine 18. A firing pin (not shown) is supported in a rearward end inserting manner within a bolt carrier by way of a retaining pin, as is known in the art. The lower housing 11 includes takedown pins for mounting the upper receiver assembly 12 to the lower receiver assembly 14. A buffer tube assembly may be threaded into the rear of the lower housing 11 for mounting the buttstock 13. Magazine 18 may be internally mounted within lower receiver housing 11 and may have a magazine spring and an upper displaceable follower in biasing fashion relative to a floor plate mounted to the bottom of the magazine.

When assembled, within an open receiving bottom location of the lower housing 11, there is a pre-loading of cartridges into the lower receiver assembly 14. A trigger 15 with a trigger guard may be mounted on the underside of the lower housing 11. The lower receiver assembly 14 includes takedown and pivot pins, a hammer and associated spring, a bolt catch, a magazine catch, a safety selector lever, a bolt catch plunger, buffer tube assembly and a buttstock assembly. All of these elements are well-known in the art and will not be further described. Upper hand guard 17 and lower hand guard 19 are secured each to the other around the barrel 16. In general, such hand guards 17 and 19 may be further accommodated with an inner heat shield liner and upper/lower hand guards 17/19 are sandwiched around barrel 16.

Thus, the standard AR-15 rifle 10 includes a barrel 16 mounted to the upper receiver assembly 12 and the upper receiver may include a forward assist mechanism 20 for assisting in the displacement of a standard bolt (not shown).

In order to convert the standard AR-15 rifle 10 to a muzzle loading system, a number of components of the standard AR-15 rifle 10 must be replaced and provided in combination to provide the conversion of the standard AR-15 rifle 10 to a muzzle loading firing mechanism or system.

Transformation of a standard semi-automatic rifle 10 into a muzzle loading firearm requires a number of changes to the standard semi-automatic rifle 10. Various elements must be removed and elements to be described in detail in following paragraphs replace elements in the standard semi-automatic rifle 10.

Initially, since the standard semi-automatic rifle 10 is being converted to a muzzle loading firearm, the standard gas return tube mounted generally adjacent the barrel 16 is removed. Additionally, since the conversion results in a converted rifle 30 (FIG. 2) which is muzzle loading, there is no need for a cartridge extractor which is now replaced by a breech plug mechanism to be further described in following paragraphs.

Additionally, the forward assist mechanism 20 of the standard AR-15 rifle 10 is replaced with a bolt locking mechanism where the standard forward assist generally contains forward assist plungers, associated pawls and springs, and such are removed from the converted rifle 30.

As will be seen in the following paragraphs, changes are made to specific components of the standard AR-15 semi-automatic rifle 10 wherein changes include:

a) development of a breech plug mechanism which can be secured to the breech end of the barrel, with the breech plug mechanism having a valve member permitting gaseous flow therethrough;
b) development of a barrel which is machined to have a thread passing throughout the breech end section of the barrel for threaded engagement with the breech plug mechanism;
c) machining the standard forward assist mount to provide a threaded through opening;
d) develop a bolt locking mechanism which includes a locking pin collar and a bolt locking pin wherein the bolt locking pin is threadedly engaged with the locking pin collar and the locking pin collar includes a threaded collar section which is threaded within the machined forward assist;
e) develop a bolt alignment member which is fixedly attached to an upper surface of the bolt member for alignment of the bolt within the upper receiver.

With the above development of new elements and machining of standard parts of the standard AR-15 semi-automatic rifle 10, there is produced a converted rifle 30 in accordance with the subject system concept.

Figure 2:
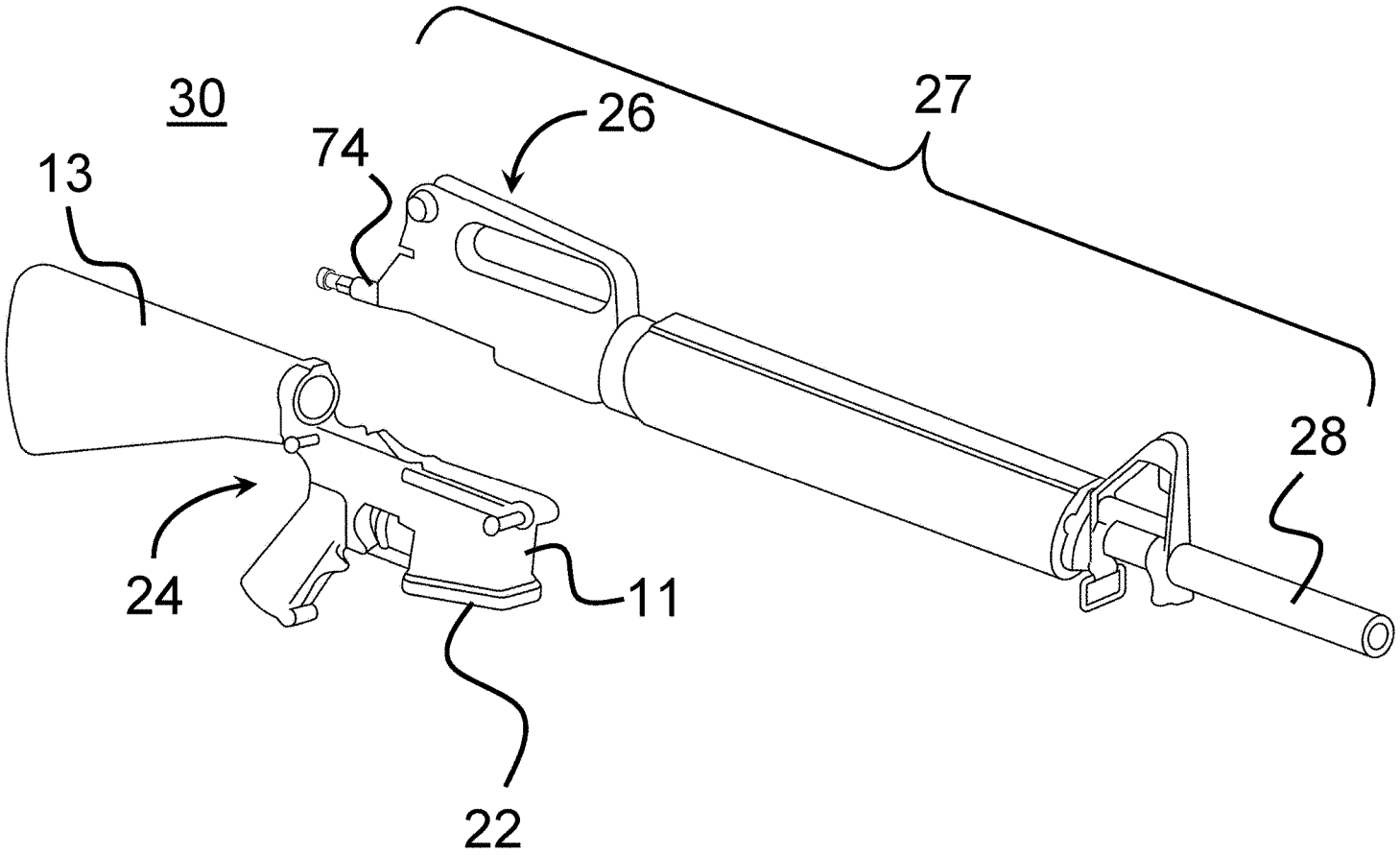
FIG. 2 is a partial schematic depiction of the subject conversion kit showing the upper receiver and lower receiver modified to be a muzzle loading rifle.

FIG. 2 shows a schematic depiction of basic components of converted rifle 30. As can be seen in the conversion rifle 30, lower receiver assembly 24 remains substantially the same as the standard AR-15 lower receiver assembly 14, however, since this is a muzzle loading firearm, there is no necessity for having a magazine insert portion in the lower receiver housing 11. Thus, cap 22 is provided to enclose the opening where magazine 18 of a standard AR-15 rifle 10 would be inserted. The only restriction associated with the cap is that it be close-fitting and be fixedly secured to the lower receiver housing 11 in order to minimize contact with the external environment. Thus, contamination is minimized. The lower receiver assembly 24 of the converted standard rifle 30 remains substantially the same as the standard AR-15 lower receiver assembly 14. Upper receiver 26 is fixedly coupled to the barrel 28 and conversion elements will be described in following paragraphs and shown in FIGS. 3-7.

Figure 3:
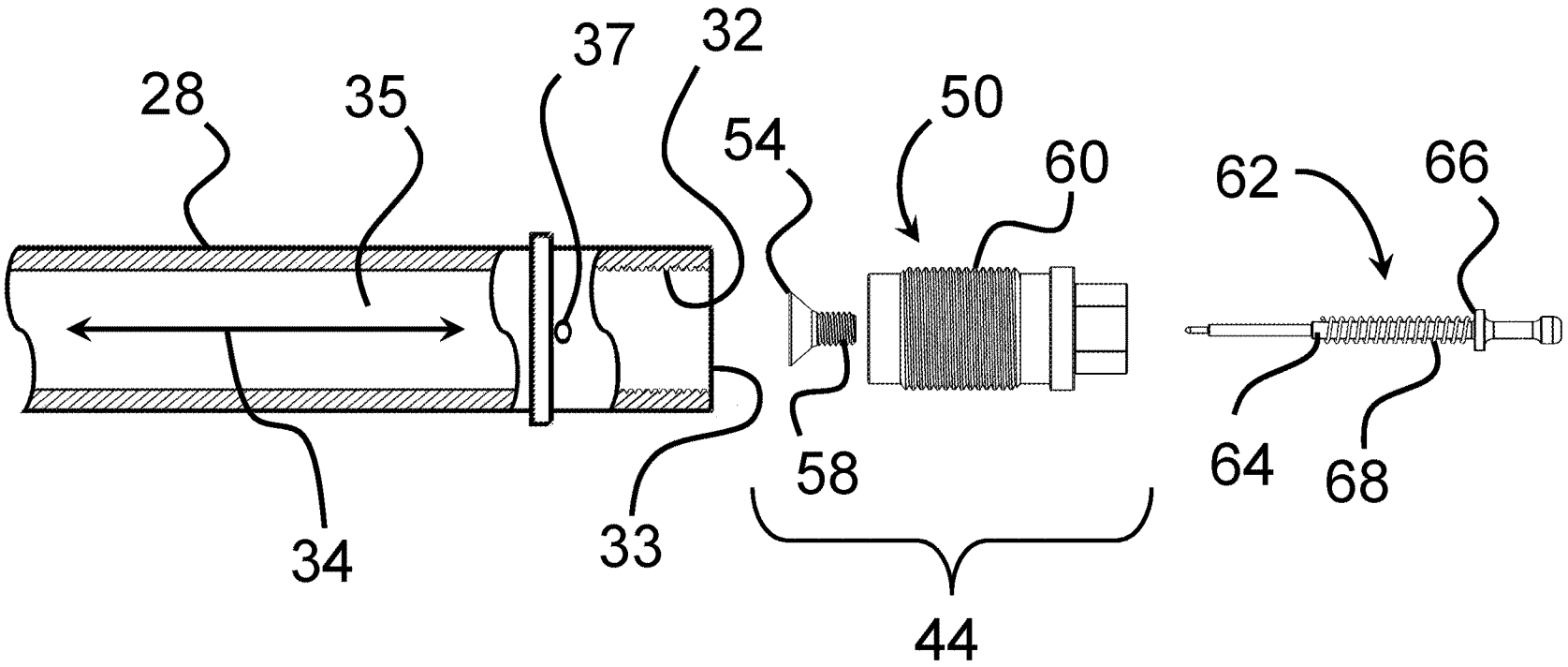
FIG. 3 is a depiction of a breech plug in accordance with the subject conversion kit which is threadedly secured into a barrel of a rifle showing the firing pin, breech plug, and barrel in cross-section.

As is the case in the standard AR-15 rifle system 10, the upper receiver assembly 27 (FIG. 2) is mounted to the lower receiver assembly 24 of the converted rifle 30. Barrel 28 is modified to provide an internal thread 32, as shown in FIG. 3, where the threads 32 extending fully to the end of barrel 33. Barrel 28 is adapted to be slidingly secured into the upper receiver 26. Barrel 28 extends in longitudinal direction 34 and may be formed of a stainless steel composition, or some like metal composition, sufficient in structural integrity to accept the forces applied thereto. Converted barrel 28 includes barrel primary chamber 35 which is in fluid communication with barrel breech end 33. In order to stabilize barrel 28 from rotational displacement, locking pin 37 is provided for extension into the upper receiver 26.

Figure 6:
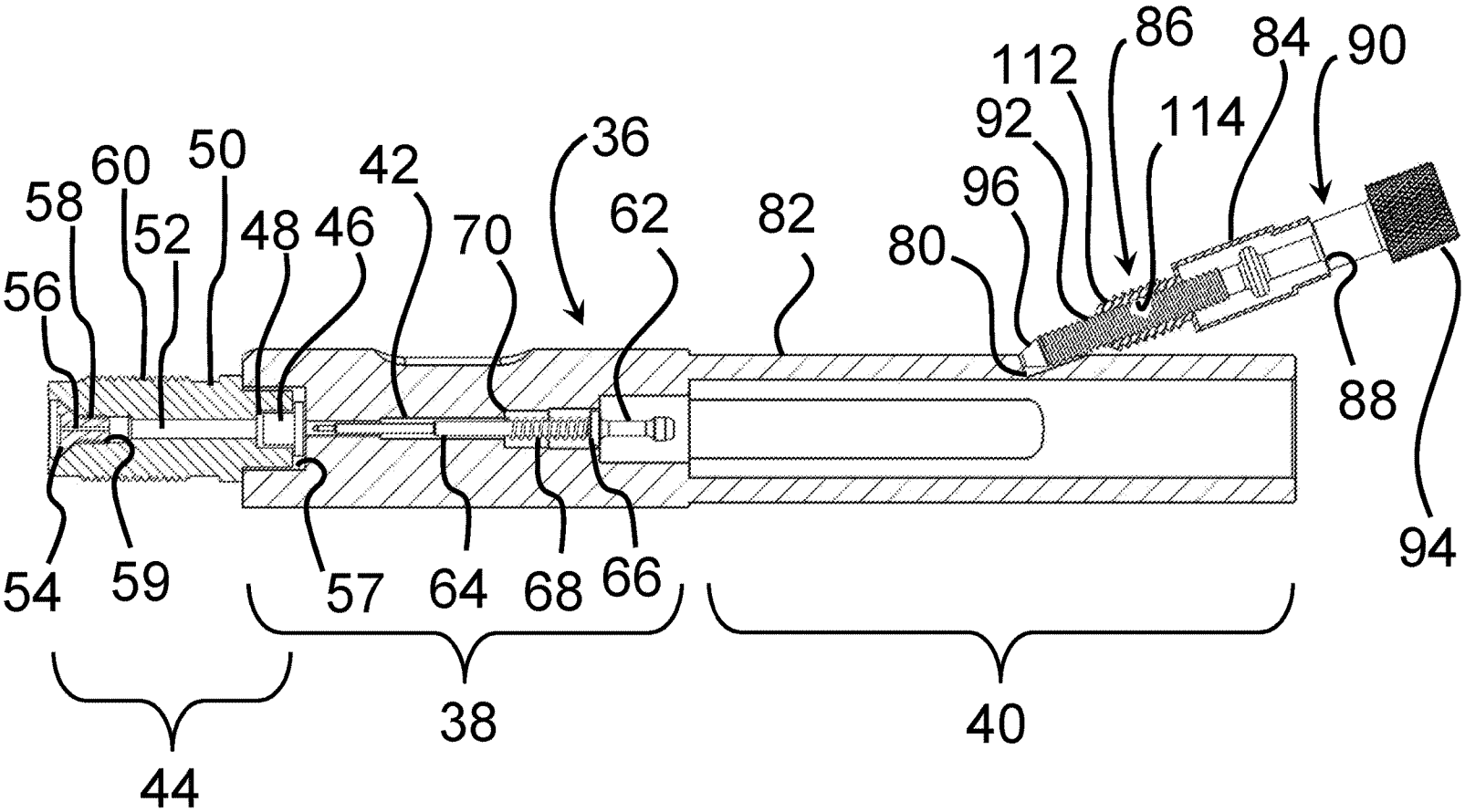
FIG. 6 is a cross-sectional view of the bolt member having the breech plug mechanism inserted therein and a stationary bolt holding mechanism insertable within a recess formed in the bolt.
Figure 7:
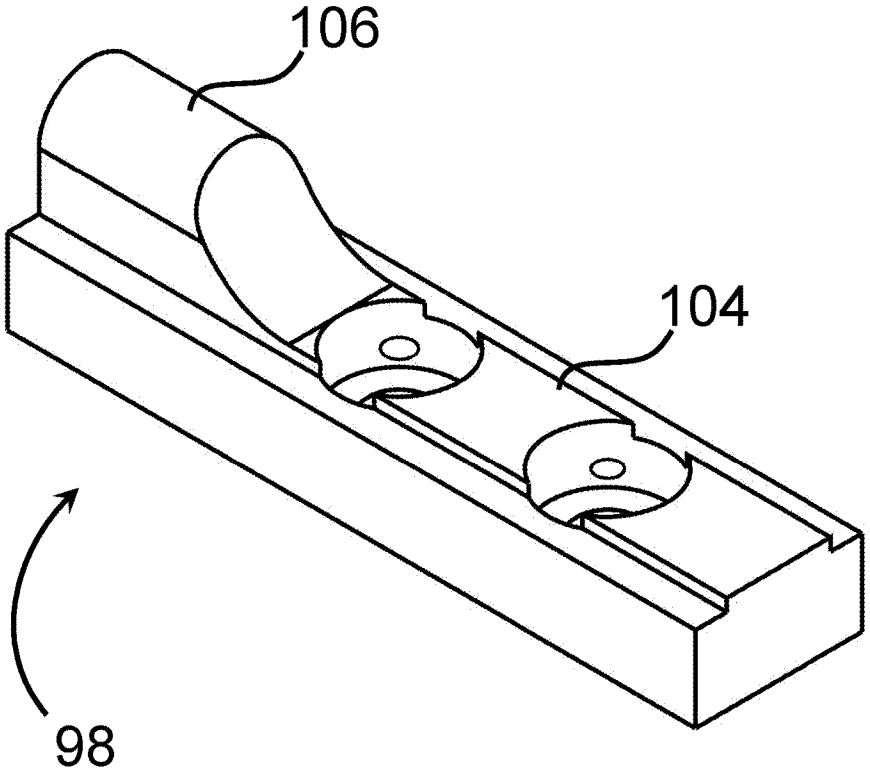
FIG. 7 is a perspective view of the bolt alignment mechanism.

Referring now to FIG. 6, bolt member 36, is positioned within upper receiver 26 with the bolt member 36 having bolt first section 38 and a bolt second section 40. Bolt first section 38 includes a bolt through opening 42 extending throughout bolt first section 38. The detailed description of bolt member 36, as shown in FIG. 6, will be detailed in following paragraphs.

Returning to FIG. 3 in conjunction with FIG. 6, breech plug mechanism 44 is threadedly secured to barrel 28 with breech plug mechanism 44 adapted to receive primer 46 within a breech plug mechanism chamber 48. The breech plug member 50 includes a longitudinally extending breech plug through opening 52, seen in FIG. 6, where FIG. 6 depicts the breech plug mechanism 44 inserted into the bolt member 36 within the bolt first section 38. The breech plug member 50 is insertable within breech plug member receiving chamber 57 formed within the bolt first section 38.

Breech plug mechanism 44 further includes breech plug nozzle member 54 which has a breech plug nozzle through opening 56 in fluid communication with the breech plug through opening 52. Breech plug nozzle member 54 includes nozzle member threaded section 58 which are threadedly engageable with internal threads 59 of the breech plug member 50. Breech plug nozzle member 54 is a separate component of breech plug mechanism 44 with respect to breech plug member 50 so that in the event of failing, breech plug nozzle member 54 may be easily unthreaded from breech plug member 50 and can be replaced. Additionally, the threaded engagement of breech plug nozzle member 54 to the breech plug member 50 provides a secure engagement therebetween. In this manner, it is to be noted that removal of the breech plug mechanism from barrel 28 results in a one-piece removal of both the breech plug member 50 and the breech plug nozzle member 54.

Breech plug mechanism 44 having breech plug member 50 includes external threads 60 formed on an outer surface of the breech plug member 50 where the threads in a manner where the threads 60 interface and are threadedly secured with the internal threads 32 of barrel 28. It is noted that the internal threads 32 of the barrel 28 extend throughout an end section of the barrel 28 where the threads extend to the breech end 33 of the barrel 28. In this manner, breech plug member 50 is secured to converted barrel 28.

As is further seen in FIG. 3, firing pin 62 is adapted to be insertable and mounted within bolt first section 38 (as shown in FIG. 6) and is in longitudinal alignment with breech plug member 50, as shown in FIG. 3.

Firing pin 62 includes firing pin shaft 64. Firing pin shaft 64 has shoulder section 66 to provide a stop member for damping mechanism 68, which bears against the firing pin shaft shoulder 66 on a first end and bears against the bolt shoulder 70, as shown in FIG. 6, on an opposing second end. Damping mechanism 68 may be a helical spring mounted around firing pin shaft 64 and bears against the bolt shoulder on an opposing end. Damping member 58 in the form of a helical spring is provided to prevent or minimize accidental striking of the primer 46 by the firing pin 62.

Figure 4:
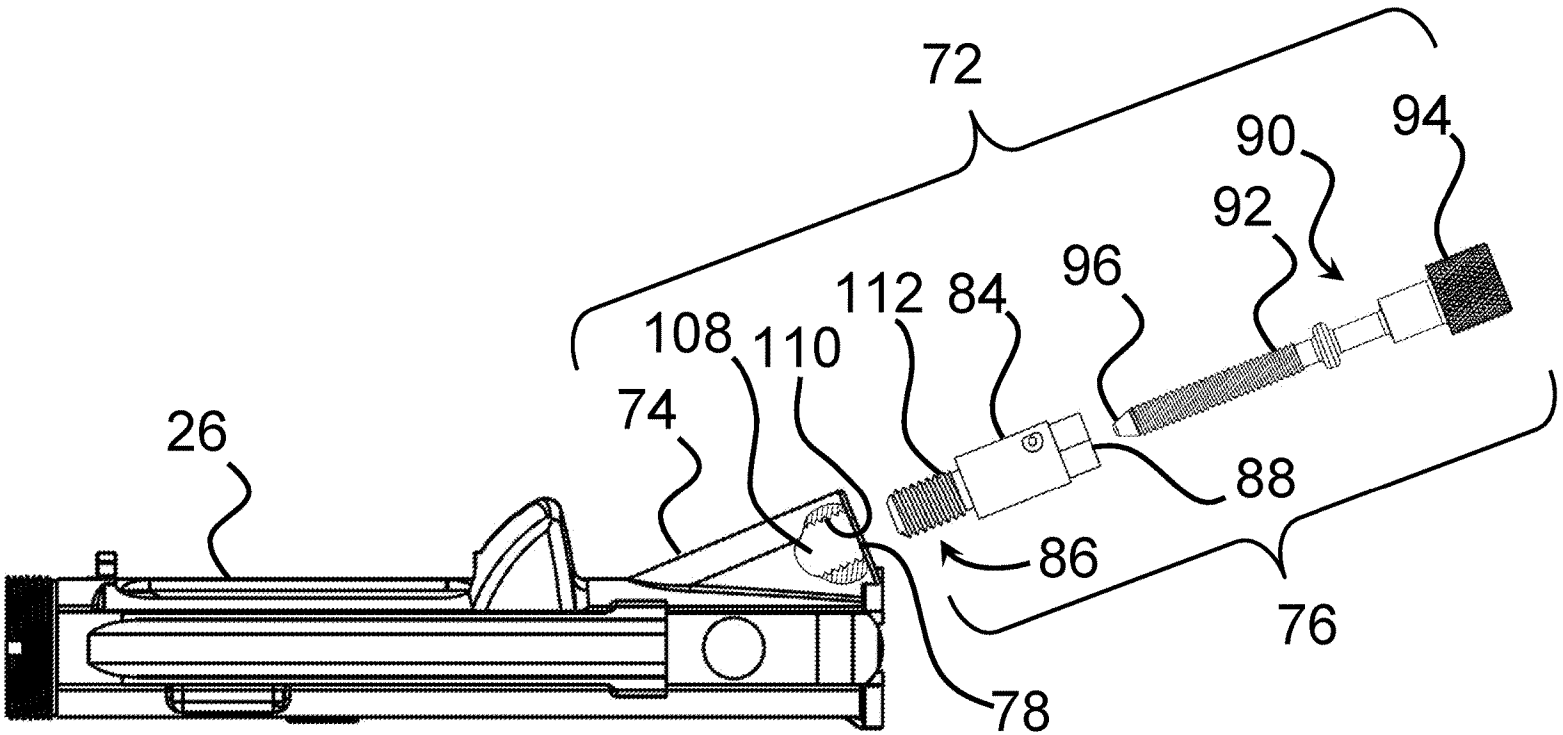
FIG. 4 is an elevational view of an assist mount mounted integral to an AR15 upper receiver and the stationary bolt holding mechanism which includes a bolt locking pin threadedly insertable within a locking pin collar.

Referring now to FIGS. 4 and 6, the conversion kit of the subject system includes stationary bolt holding mechanism 72 for maintaining bolt member 36 stationary during operation of the firearm. Bolt holding mechanism 72 is mounted to upper receiver 26 and the stationary bolt holding mechanism 72 includes assist mount housing 74. Assist mount housing 74 is standard in an AR-15 rifle upper receiver 12 and 26. Stationary bolt holding mechanism 72 includes bolt locking mechanism 76 which is shown in exploded view in FIG. 4 and in cross-sectional view in FIG. 6. Bolt locking mechanism 76 is adapted for threaded engagement within assist mount 74 within an assist mount threaded through opening 78.

Assist mount member 74 includes assist mount chamber 108 within which locking pin collar 84 will be threadedly engaged. Assist mount internal threads 110 deviate from the standard AR-15 rifle assist mount, in that the threads 110 are formed in the assist mount chamber 108 to accept threaded engagement by the external threads 112 of the locking pin collar 84.

Bolt locking mechanism 76 engages with bolt recess 80 (shown in FIG. 6) formed within the bolt outer wall 82. Bolt locking mechanism 76 further includes locking pin collar 84, which is adapted for threaded securement to assist mount 74 by the threaded engagement of the threads 110 and 112. Thus, there is securement between the locking pin collar 84 within the assist mount chamber 108 by threaded securement of the locking pin collar threaded section 86 which threadedly engages with the threaded through opening 78 of assist mount 74.

Bolt locking mechanism 76 further includes bolt locking pin 90 which has a bolt locking pin threaded section 92 for engaging with internal threads 114 of the locking pin collar 84 after passing through locking pin collar opening 88. For clarity purposes, locking pin collar opening 88 is shown in breakaway form in FIG. 6, which shows the bolt locking mechanism 76 without the assist mount 74.

In this manner, bolt locking pin 90 is threadedly secured to assist mount 74 and by rotation of locking pin knob 94, locking pin end section 96 is displaceable into recess 80 formed in bolt second section 40. When bolt locking pin 90 is displaced (by rotation of knob 94) into bolt recess 80, there is a fixed coupling of the bolt locking pin 90 to the assist mount 74 and the upper receiver 26. Through this combination, bolt member 36 is maintained in a stationary position.

Figure 5A:
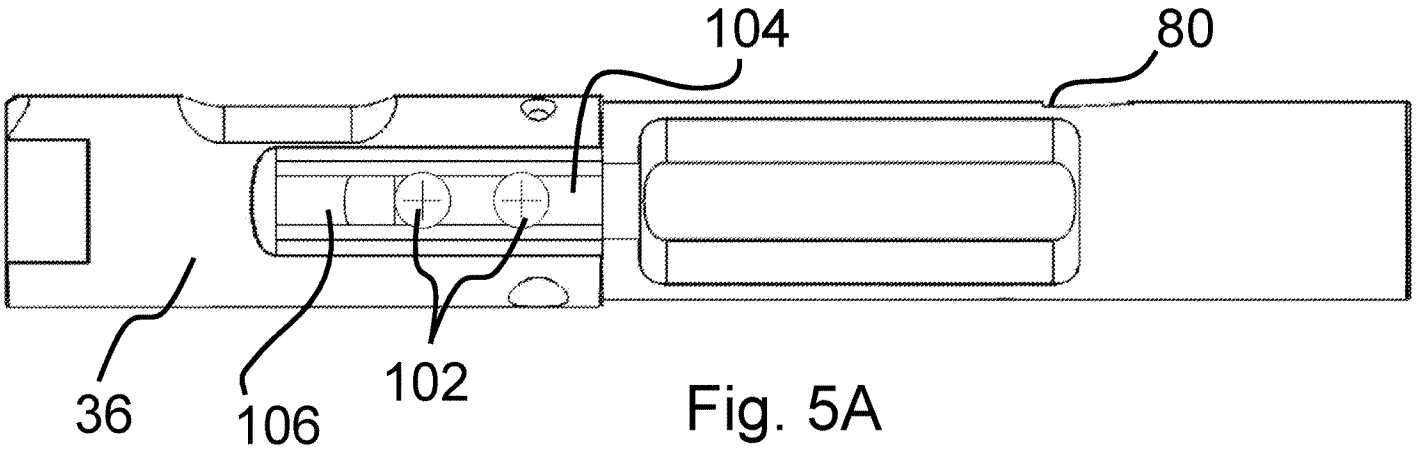
FIG. 5A is an elevational view of a bolt showing a bolt alignment mechanism.
Figure 5B:
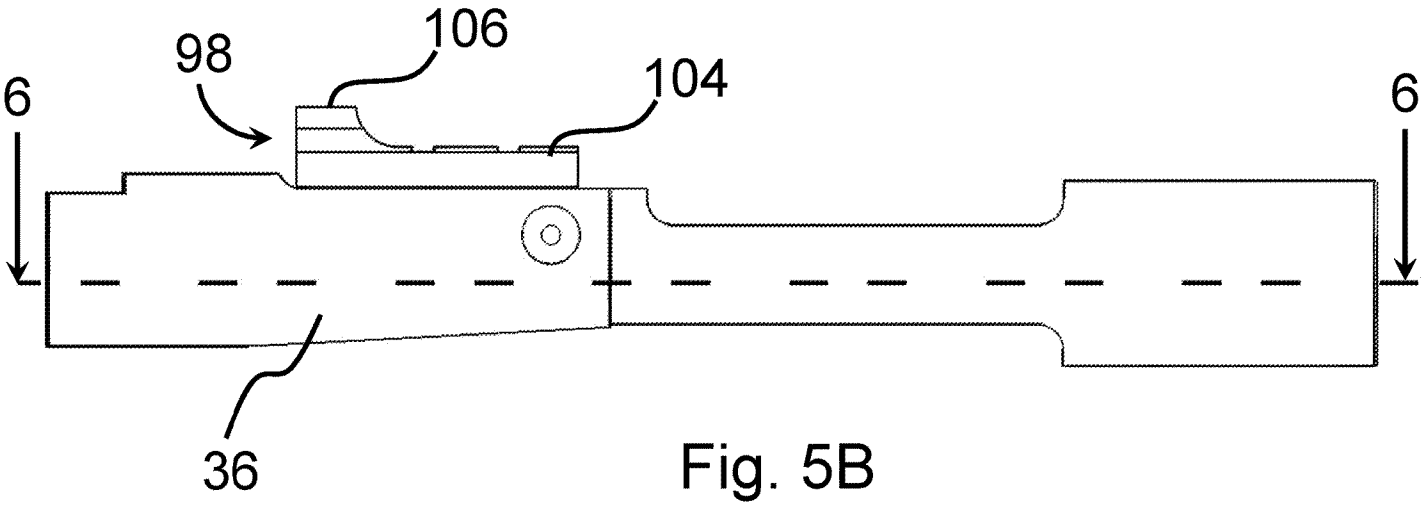
FIG. 5B is a side view of a bolt showing the bolt alignment mechanism mounted to the bolt and insertable within a slot of the upper receiver.
Figure 8:
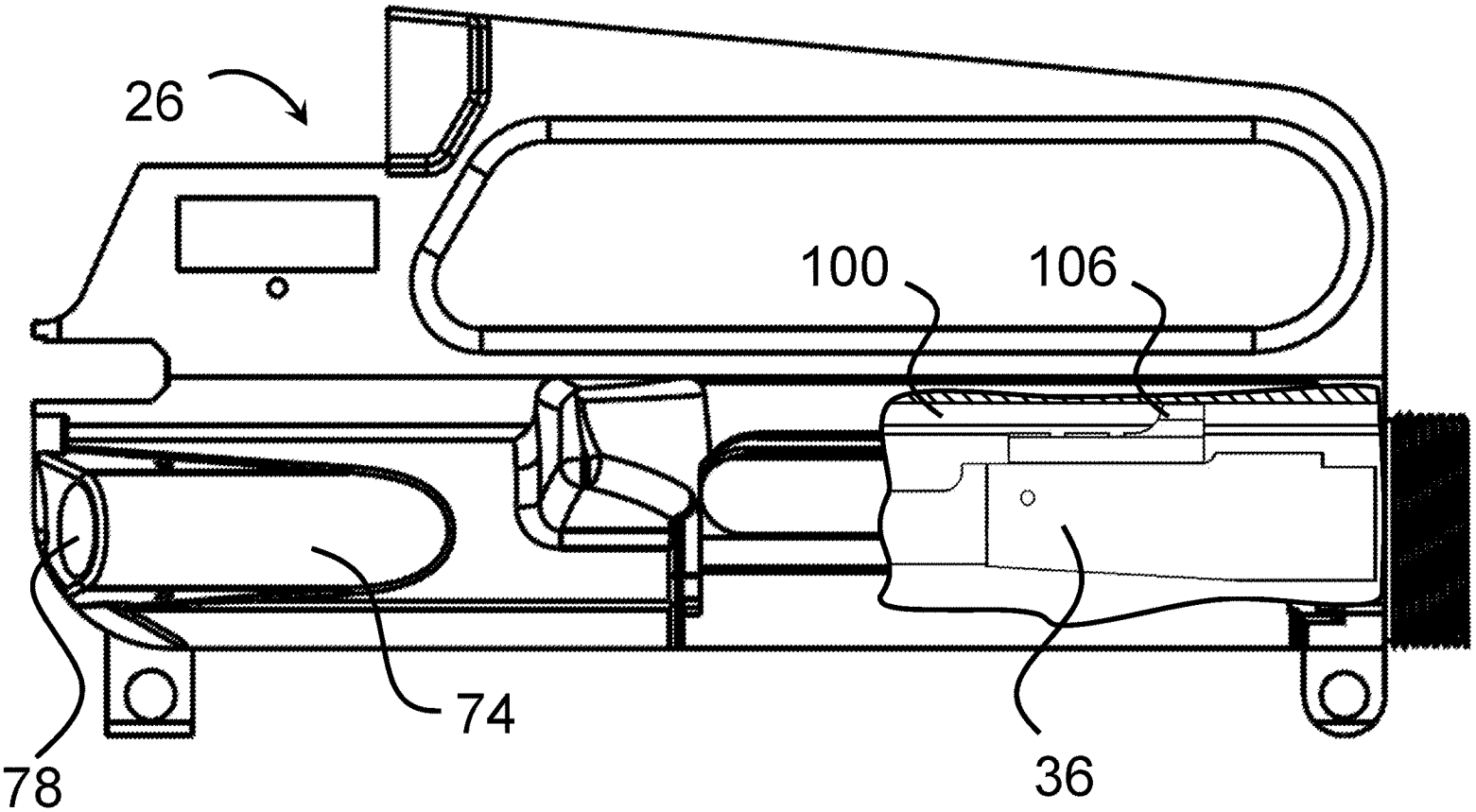
FIG. 8 is a side view of the upper receiver with a partial cross-sectional view showing the position of the bolt alignment mechanism within the slot of the upper receiver.

Referring now to FIGS. 5A and 5B, the conversion system includes a bolt alignment member 98 which is secured to bolt member 36 and is slideably inserted into slot 100 (FIG. 8) of upper receiver 26. Bolt alignment member 98 extends in longitudinal direction 34 and is bolted or otherwise fixedly secured by bolts 102 to bolt member 36. As further seen in FIGS. 5B and 7, bolt alignment member 98 includes a bolt alignment base 104 fixedly secured to bolt 36. As is more clearly seen in FIGS. 7 and 8, bolt alignment member 98 includes a bolt alignment lug member 106 which is insertable within slot 100 formed in upper receiver 26. In this manner, bolt alignment lug member 106 permits reversible displacement of bolt member 36 with respect to upper receiver 26. With the insert of bolt alignment lug member 106 within upper receiver slot 100, bolt member 36 is restrained from rotation about the longitudinal direction 34.

Referring to FIG. 2, the complete muzzle-loading upper receiver assembly 27 attaches to a standard AR15 lower receiver assembly 24 via the takedown and pivot pins provided in lower receiver assembly 24. The muzzle-loading upper receiver assembly 27 is loaded by using a standard range rod, solid ram rod or collapsible ram rod. The muzzle-loading upper receiver assembly 24 is primed for firing by inserting a 209 shotgun primer into breech plug 60 by using standard primer holding, insertion and removal tools. The breech plug assembly 60 is removed for cleaning and maintenance by using a standard 7/16 socket and extension. The lower receiver housing 11 can be sealed from external contamination by using standard magazine well plugs or covers 22.

Although this invention has been described in connection with specific forms and embodiments thereof, it will be appreciated that various modifications other than those discussed above may be resorted to without departing from the spirit or scope of the invention as defined in the appended claims. For example, functionally equivalent elements may be substituted for those specifically shown and described, certain features may be used independently of other features, and in certain cases, particular locations of elements, steps, or processes may be reversed or interposed, all without departing from the spirit or scope of the invention as defined in the appended claims.

What is claimed is:

1. A muzzle loading conversion system for a rifle comprising:

(a) an upper receiver assembly mounted to a lower receiver assembly of said rifle, said upper receiver assembly having an upper receiver;

(b) a barrel defining a barrel through opening having an internal thread formed through a barrel end section, said barrel being slidingly secured on said upper receiver, and extending in a longitudinal direction;

(c) a stationary bolt member positioned within said upper receiver, said bolt member having a bolt first section and a bolt second section, said bolt first section having a bolt through opening passing therethrough;

(d) a firing pin slideably received within said bolt through opening; and, (e) a breech plug mechanism threadedly secured to said barrel within said barrel end section, said breech plug mechanism adapted to receive a primer within a breech plug mechanism chamber in fluid communication with said bolt through opening, said breech plug mechanism matingly engaged with bolt member within a breech plug member receiving chamber formed in said bolt first section;

wherein said breech plug mechanism includes:

a breech plug member having a longitudinally extending breech plug through opening; and, a breech plug nozzle member having a breech plug nozzle member through opening in fluid communication with said breech plug member through opening and said barrel;

said breech plug member includes a breech plug member first end section for insert thereof of said primer;

said breech plug nozzle member is secured to a second end section of said breech plug member; and said breech plug nozzle member is threadedly secured to an inner wall of said breech plug member.

2. The muzzle loading conversion system as recited in claim 1 where said breech plug member includes breech plug member outer threads for threaded securement to said barrel.

3. The muzzle loading conversion system as recited in claim 1 where said firing pin extends in said longitudinal direction and is insertable within said bolt through opening for positioning adjacent said primer inserted within said breech plug mechanism chamber.

4. The muzzle loading conversion system as recited in claim 1 wherein said firing pin includes a damping member surrounding a shaft of said firing pin to prevent inadvertent displacement of said firing pin against said primer.

5. The muzzle loading conversion system as recited in claim 4 where said damping member includes a helical spring surrounding a portion of said firing pin shaft.

6. The muzzle loading conversion system as recited in claim 1 including a stationary bolt holding mechanism mounted to said upper receiver for maintaining said bolt in a fixed position.

7. The muzzle loading conversion system as recited in claim 6 where said stationary bolt holding mechanism includes:

(a) an assist mount fixedly secured to said upper receiver, said assist mount having a threaded through opening;

(b) a bolt locking mechanism for threaded engagement within said assist mount through opening, said bolt locking mechanism for engagement with a recess formed in said bolt second section.

8. The muzzle loading conversion system as recited in claim 7 where said bolt locking mechanism includes:

(a) a locking pin collar having a locking pin collar threaded section for threadedly engaging said assist mount threaded opening, said locking pin collar having a locking pin collar threaded through opening; and, (b) a bolt locking pin having a bolt locking pin threaded section for threadedly engaging said bolt locking pin being threadedly engaged with said locking pin through opening.

9. The muzzle loading conversion system as recited in claim 1 including a bolt alignment member secured to said bolt for slideable insert into an upper receiver slot extending in said longitudinal direction for negating rotation of said bolt with respect to said longitudinal direction.

10. The muzzle loading conversion system as recited in claim 9 where said bolt alignment member includes:

(a) a bolt alignment base fixedly secured to said bolt; and, (b) a bolt alignment lug member insertable into said upper receiver slot for permitting reversible displacement of said bolt with respect to said upper receiver.

11. The muzzle loading conversion system as recited in claim 1 where said lower receiver assembly includes:

(a) a lower receiver magazine insert section;

(b) a cap member extending around said lower receiver magazine insert section for sealing the insert section from the external environment.

12. A muzzle loading conversion system for a rifle comprising:

an upper receiver assembly mounted to a lower receiver assembly of said rifle, said upper receiver assembly having an upper receiver;

a barrel defining a barrel through opening having an internal thread formed through a barrel end section, said barrel being slidingly secured on said upper receiver, and extending in a longitudinal direction;

a stationary bolt member positioned within said upper receiver, said bolt member having a bolt first section and a bolt second section, said bolt first section having a bolt through opening passing therethrough;

a firing pin slideably received within said bolt through opening;

a breech plug mechanism threadedly secured to said barrel within said barrel end section, said breech plug mechanism adapted to receive a primer within a breech plug mechanism chamber in fluid communication with said bolt through opening, said breech plug mechanism matingly engaged with bolt member within a breech plug member receiving chamber formed in said bolt first section; and a stationary bolt holding mechanism mounted to said upper receiver for maintaining said bolt in a fixed position;

where said stationary bolt holding mechanism includes:

an assist mount fixedly secured to said upper receiver, said assist mount having a threaded through opening; and a bolt locking mechanism for threaded engagement within said assist mount through opening, said bolt locking mechanism for engagement with a recess formed in said bolt second section.

13. The muzzle loading conversion system as recited in claim 12 where said bolt locking mechanism includes:

a locking pin collar having a locking pin collar threaded section for threadedly engaging said assist mount threaded opening, said locking pin collar having a locking pin collar threaded through opening; and, a bolt locking pin having a bolt locking pin threaded section for threadedly engaging said bolt locking pin being threadedly engaged with said locking pin through opening.

14. The muzzle loading conversion system as recited in claim 12 wherein said firing pin includes a damping member surrounding a shaft of said firing pin to prevent inadvertent displacement of said firing pin against said primer.

15. A muzzle loading conversion system for a rifle comprising:

an upper receiver assembly mounted to a lower receiver assembly of said rifle, said upper receiver assembly having an upper receiver;

a barrel defining a barrel through opening having an internal thread formed through a barrel end section, said barrel being slidingly secured on said upper receiver, and extending in a longitudinal direction;

a stationary bolt member positioned within said upper receiver, said bolt member having a bolt first section and a bolt second section, said bolt first section having a bolt through opening passing therethrough;

a firing pin slideably received within said bolt through opening; and, a breech plug mechanism threadedly secured to said barrel within said barrel end section, said breech plug mechanism adapted to receive a primer within a breech plug mechanism chamber in fluid communication with said bolt through opening, said breech plug mechanism matingly engaged with bolt member within a breech plug member receiving chamber formed in said bolt first section;

including a bolt alignment member secured to said bolt for slideable insert into an upper receiver slot extending in said longitudinal direction for negating rotation of said bolt with respect to said longitudinal direction.

16. The muzzle loading conversion system as recited in claim 15 where said bolt alignment member includes:

a bolt alignment base fixedly secured to said bolt; and, a bolt alignment lug member insertable into said upper receiver slot for permitting reversible displacement of said bolt with respect to said upper receiver.

17. The muzzle loading conversion system as recited in claim 15 wherein said firing pin includes a damping member surrounding a shaft of said firing pin to prevent inadvertent displacement of said firing pin against said primer.

* * * * *